US008940993B1

(12) United States Patent
Micek

(10) Patent No.: US 8,940,993 B1
(45) Date of Patent: Jan. 27, 2015

(54) VARIABLE TONE CONFIGURATION CONTROL FOR STRING INSTRUMENTS

(71) Applicant: Petr Micek, Baltimore, MD (US)

(72) Inventor: Petr Micek, Baltimore, MD (US)

( * ) Notice: Subject to any disclaimer, the term of this patent is extended or adjusted under 35 U.S.C. 154(b) by 0 days.

(21) Appl. No.: 14/063,343

(22) Filed: Oct. 25, 2013

Related U.S. Application Data

(60) Provisional application No. 61/859,845, filed on Jul. 30, 2013.

(51) Int. Cl.
*G10H 3/18* (2006.01)

(52) U.S. Cl.
USPC ..... 84/727; 84/725; 84/726; 84/728

(58) Field of Classification Search
USPC ..... 84/743, 725–728
See application file for complete search history.

(56) References Cited

U.S. PATENT DOCUMENTS

| | | | | | |
|---|---|---|---|---|---|
| 2,897,709 | A | * | 8/1959 | McCarty et al. | 84/726 |
| 3,472,943 | A | * | 10/1969 | Takeshi et al. | 84/726 |
| 3,544,696 | A | | 12/1970 | Broussard | |
| 3,603,713 | A | * | 9/1971 | Nakada | 84/697 |
| 3,663,735 | A | * | 5/1972 | Evans | 84/721 |
| 4,222,301 | A | | 9/1980 | Valdez | |
| 4,281,573 | A | * | 8/1981 | Yarema | 84/741 |
| 4,405,832 | A | * | 9/1983 | Sondermeyer | 381/61 |
| 4,423,654 | A | * | 1/1984 | Yamagami | 84/726 |
| 4,532,847 | A | * | 8/1985 | Youngblood | 84/741 |
| 4,581,974 | A | * | 4/1986 | Fender | 84/725 |
| 4,581,975 | A | * | 4/1986 | Fender | 84/725 |
| 4,819,537 | A | * | 4/1989 | Hayes et al. | 84/736 |
| 5,136,918 | A | * | 8/1992 | Riboloff | 84/723 |
| 5,311,806 | A | * | 5/1994 | Riboloff | 84/728 |
| 5,569,038 | A | * | 10/1996 | Tubman et al. | 434/308 |
| 5,761,316 | A | * | 6/1998 | Pritchard | 381/61 |
| 5,932,827 | A | * | 8/1999 | Osborne et al. | 84/726 |
| 6,121,537 | A | | 9/2000 | Pawar et al. | |
| 6,998,529 | B2 | * | 2/2006 | Wnorowski | 84/726 |
| 7,115,810 | B2 | * | 10/2006 | Ambrosino | 84/742 |
| 7,271,332 | B2 | * | 9/2007 | Clark | 84/736 |
| 7,304,232 | B1 | * | 12/2007 | Nicholes | 84/741 |
| 7,601,908 | B2 | * | 10/2009 | Ambrosino | 84/742 |
| 7,674,991 | B2 | * | 3/2010 | Baird et al. | 200/61.29 |
| 7,982,123 | B2 | | 7/2011 | Mulvany | |
| 8,253,007 | B1 | * | 8/2012 | Steinberger | 84/725 |
| 8,324,495 | B2 | | 12/2012 | Jacob | |

(Continued)

FOREIGN PATENT DOCUMENTS

| | | | |
|---|---|---|---|
| GB | 2207542 | A | 2/1989 |
| GB | 2235562 | A | 3/1991 |
| WO | 92/13337 | A1 | 8/1992 |

*Primary Examiner* — David S. Warren
(74) *Attorney, Agent, or Firm* — Rosenberg, Klein & Lee

(57) ABSTRACT

A variable tone configuration control (100, 100') for string instruments includes a pair of pickup coils (110, 120) located on a string instrument for inducing voltages therein responsive to vibration of any of the strings thereof. The variable tone configuration control (100, 100') further includes a pair of potentiometers (130, 140) mechanically coupled for concurrent mechanical travel of a respective displaceable contact (132, 142) thereof. The pair of potentiometers (130, 140) are operatively coupled to the pair of pickup coils (110, 120) and a pair of output terminals (102, 104) to vary the electrical configuration of the pair of pickup coils (110, 120) between the pair of pickup coils (110, 120) being connected in series and being connected in parallel as the displaceable contacts (132 and 142) are moved between opposing ends of their mechanical travel.

21 Claims, 9 Drawing Sheets

(56) References Cited

U.S. PATENT DOCUMENTS

| | | | | |
|---|---|---|---|---|
| 2002/0073829 | A1 | 6/2002 | Gaglio | |
| 2002/0073830 | A1 | 6/2002 | Petherick | |
| 2003/0145715 | A1* | 8/2003 | Wnorowski | 84/726 |
| 2004/0159225 | A1* | 8/2004 | Barr | 84/743 |
| 2006/0156903 | A1* | 7/2006 | Baird et al. | 84/453 |
| 2006/0156912 | A1 | 7/2006 | Annis et al. | |
| 2007/0006718 | A1* | 1/2007 | Clark | 84/736 |
| 2009/0308233 | A1* | 12/2009 | Jacob | 84/726 |
| 2010/0208916 | A1* | 8/2010 | Jacob | 381/104 |
| 2010/0282046 | A1* | 11/2010 | Crocker | 84/633 |
| 2010/0307325 | A1* | 12/2010 | Appel | 84/743 |
| 2011/0017048 | A1* | 1/2011 | Bos | 84/600 |
| 2011/0219942 | A1* | 9/2011 | Robertson | 84/735 |
| 2011/0259180 | A1* | 10/2011 | Gournis | 84/746 |
| 2014/0219477 | A1* | 8/2014 | Scott | 381/118 |

* cited by examiner

VARIABLE TONE CONFIGURATION CONTROL FOR STRING INSTRUMENTS

REFERENCE TO RELATED APPLICATION

This application is based on Provisional Application 61/859,845, filed 30 Jul. 2013, the disclosure of which is expressly incorporated herein by reference in its entirety.

BACKGROUND OF THE INVENTION

This disclosure directs itself to a variable tone configuration control for string instruments that permits switching between series and parallel configurations of pairs of electromagnetic pick-up coils and intermediate variations thereof. More in particular, the disclosure is directed to a variable tone configuration control for string instruments that includes a pair of pickup coils disposed on a string instrument for inducing voltages therein responsive to vibration of at least one string of the string instrument and the pair of potentiometers are coupled to a pair of output terminals and the displaceable contact of each of the potentiometers is electrically connected to a respective one of the pair of pickup coils for selective operative coupling of the pair of pickup coils coupled in series to the output terminals, or the pair of pickup coils coupled in parallel to the output terminals, responsive to a position of displaceable contacts of the pair of potentiometers. Still further, the disclosure is directed to a system wherein the selective operative coupling between the pair of pickup coils and the output terminals that is provided by the pair of potentiometers additionally selectively provides the effective coupling of only one of the pair of pickup coils to the output terminals. Further, the system can provide selective operative coupling of one of said pair of pickup coils in combination with a series coupling of the pair of pickup coils, or can provide selective operative coupling of a the pair of pickup coils where the output provides contributions from both series and parallel coupling of the pair of pickup coils.

Electric string instruments, such as electric guitars, electric bases, electric violins, etc., use a pickup to convert the vibration of instrument's strings into electrical impulses. The most commonly used pickups uses the principle of direct electromagnetic induction. The signal generated by the pickup is of insufficient strength to directly drive an audio transducer, such as a loudspeaker, so it must be amplified prior to being input to the audio transducer.

Because of their natural inductive qualities, all magnetic pickups tend to pick up ambient electromagnetic interference (EMI) from electrical power wiring in the vicinity, such as the wiring in a building. The EMI from a 50 or 60 Hz power system can result in a noticeable "hum" in the amplified audio by from the audio transducer, particularly with poorly shielded single-coil pickups. Double-coil "Humbucker" pickups were invented as a way to overcoming the problem of unwanted ambient hum sounds. Humbucker pickups have two coils arranged to be of opposite magnetic and electric polarity so as to produce a differential signal. As ambient electromagnetic noise effects both coils equally and since they are poled oppositely, the noise signals induced in the two coils cancels out. The two coils of a Humbucker are often wired in series to give a fuller and stronger sound.

While most single coil pickups are wired in parallel with each other, it is also possible to wire them in series, producing a fuller and stronger sound. The two coils of a Humbucker type pickup can be connected in parallel. This results in a brighter sound, but at the cost of a lower output as with a single-coil pickup, but with the pickup's hum-cancelling properties still being retained. Using a multiple pole, multiple through switch, such as a double pole, double through switch (DPDT) or double pole three position switch, it is known in the art to switch the coil configuration between series and parallel, and may also provide or "coil cut" configuration (a single coil output).

Blend potentiometers, usually formed by two potentiometers ganged together to be rotated by a single shaft, allow blending together outputs of two pickup coils in varying degrees, not unlike a balance control provided in stereo equipment. Blend potentiometers, however, do not accomplish switching of the coil configuration. In one known prior art system disclosed in U.S. Pat. No. 4,423,654, a tone control formed with a pair of ganged rheostats is connected to the two coils of a Humbucker type pickup. The operation of this tone control provides a series coil configuration at one end of the rotation of the control and a parallel configuration at the opposing end of the rotation thereof. Of the two rheostats used, the resistance element of one is configured to have substantially zero resistance (zero ohms) between one end terminal and the midpoint of the resistance element's length and thereafter increase linearly, while the other rheostat has a resistance that increases logarithmically along its length. Due to the logarithmic taper of the resistance element, from the one end of the travel of the control that provides a series configuration of the coils to and including the midpoint thereof, the series configuration is maintained, changing only the high frequency attenuation included in the control.

SUMMARY OF THE INVENTION

A variable tone configuration control for string instruments is provided. The variable tone configuration control includes a pair of pickup coils disposed on a string instrument for inducing voltages therein responsive to vibration of at least one string of the string instrument. The variable tone configuration control further includes a pair of potentiometers each having a displaceable contact. The pair of potentiometers are mechanically coupled for concurrent mechanical travel of the displaceable contacts thereof. The pair of potentiometers are coupled to a pair of output terminals and one of the potentiometers is electrically connected to a single one of the pair of pickup coils. The pair of potentiometers provides selective operative coupling of the pair of pickup coils in a series connection between the output terminals, or selective operative coupling of the pair of pickup coils in a parallel connection between the output terminals, responsive to a position of the displaceable contacts.

Additionally, the selective operative coupling between the pair of pickup coils and the output terminals provided by the pair of potentiometers additionally provides effectively coupling only one of the pair of pickup coils to the output terminals responsive to another position of the displaceable contacts. The selective operative coupling between the pair of pickup coils and the output terminals further provided by said pair of potentiometers provides selective operative coupling of the one of the pair of pickup coils in combination with a series coupling of the pair of pickup coils, or the one of the pair of pickup coils in combination with a parallel coupling of the pair of pickup coils responsive to further positions of the displaceable contacts.

From another aspect, a variable tone configuration control for string instruments is provided that includes a pair of pickup coils disposed on a string instrument for inducing voltages therein responsive to vibration of at least on string of the string instrument. Each of the pair of coils has a respective first and second terminal. The variable tone configuration control further includes a pair of potentiometers each having a displaceable contact. The pair of potentiometers are mechanically coupled for concurrent mechanical travel of the displaceable contacts thereof. Each of the displaceable contacts are coupled to the first terminal of a respective one of the pair of pickup coils. Each of the pair of potentiometers has a respective pair of terminals coupled to opposing ends of a resistive element thereof at corresponding end positions of the mechanical travel, one of the pair of terminals of each of the pickup coils is coupled to a respective one of a pair of output terminals to thereby provide selective operative coupling of the pair of pickup coils coupled in series to the output terminals responsive to the displaceable contacts being positioned at one end of the mechanical travel or the pair of pickup coils coupled in parallel to the output terminals responsive to the displaceable contacts being positioned at an opposing end of the mechanical travel, or a series combination of the pair of pickup coils coupled in parallel with one of the pair of coils responsive to the displaceable contacts being positioned at other than one of the ends of mechanical travel.

DETAILED DESCRIPTION OF THE PREFERRED EMBODIMENTS

Referring to FIGS. 1-7A, there is shown tone blend configuration control 100, 100' for use with an electric string instrument. Tone blend configuration control 100, 100' provides selective variation the electrical configuration of a pair of pickup coils (110, 120) between being connected in series and being connected in parallel as well as a combination thereof without the need for electrical switches to change the configuration. In the series mode the output will be strong with a smooth attack and a deep tone, in the single primary coil mode the output will be classic single tone, and in the parallel mode, the sound will be very clean and sparkly. In one configuration, tone blend configuration control 100 also provides for selection of a single pickup coil 110.

As is known in the art, one or more magnetic pickup coils are positioned in correspondence with the strings of the instrument so that they are able to produce an electrical signal in response to vibration of at least one of the multiple strings of the instrument. Humbucker type pickups are commonly used with electric string instruments because they provide for cancellation of electromagnetic interference (EMI), such as the 50 or 60 Hz "hum" that is induced from nearby electrical power wiring. Humbucker type pickups typically have two pickup coils in a single package that are phased to provide cancellation of "out of phase" signals. A pair of separately located single coils can also be connected with opposing respective phases to provide cancellation of EMI. Tone blend configuration control 100, 100' may incorporate a pair of collocated coils as well as separately located coils in any phase relationship and located anywhere along the longitudinal extent of the strings on the instrument. Thus, they may be phased to provide noise cancellation or not, without departing from the inventive concepts embodied in tone blend configuration control 100, 100'. Both series and parallel modes can be phased for hum canceling, while in the single coil mode, there will not be a hum canceling feature. Where an instrument uses multiple Humbucker type pickups, each would be associated with a tone blend configuration control 100, 100' and conventional switching or blend controls to select or mix the signals therefrom.

Figure 1:
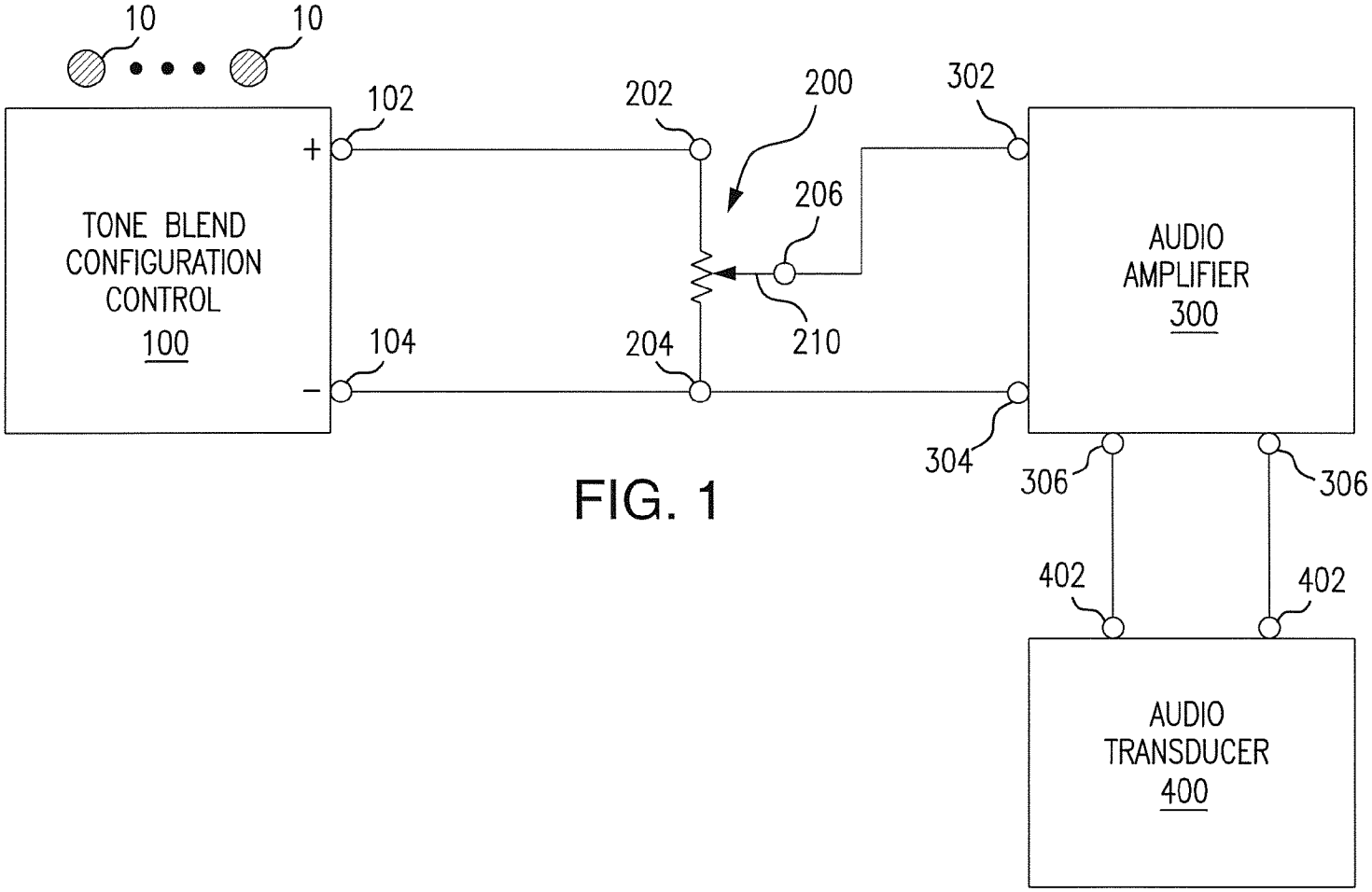
FIG. 1 is a block diagram illustrating the basic audio system for an electric string instrument incorporating the tone blend configuration control of the present invention.

Referring now to FIG. 1, there is shown a block diagram of the basic audio system for an electric string instrument that incorporates the novel tone blend configuration control 100 disclosed herein. Tone blend configuration control 100 generates voltage signals responsive to the vibrational movement of the strings of a stringed instrument, such as guitars, violins, cellos, harps, banjos, mandolins, bases, etc. The generated signals are output to terminals 102 and 104, which are respectively connected to terminals 202 and 204 of volume control 200. Volume control 200 is a potentiometer that functions as a voltage divider with its displaceable contact connected to an output terminal 206. The signal level at output terminal 206 relative to terminal 204 will be in relation to the resistance between those terminals with respect to the total resistance between terminals 202 and 204. The output of volume control 200 provided from terminals 206 and 204 are respectively coupled to terminals 302 and 304 of an audio amplifier 300. Although not illustrated in FIG. 1, it is common to add various additional tone controls between the output of volume control 200 and the input of audio amplifier 300, in the form of resistance-capacitance (RC) filters where the resistance element is a potentiometer.

FIG. 1 illustrates the most basic of setups for an electric string instrument. Modern electric string instruments, however, typically incorporate multiple Humbucker type pickups, for example one located near the bridge and another on the neck of the instrument, with blend controls being included to mix the signals from those pickups. Thus, in accordance with the disclosures made herein, each such Humbucker type pickup would be included in tone blend configuration control 100. Conventional blend controls are then connected to the output of each tone blend configuration control 100 to mix the signals provided therefrom.

The output signal level of tone blend configuration control 100 may be on the order of 100-500 mV, which can then be reduced by adjustment of volume control 200. Audio amplifier 300 increases the signal level, voltage and current, sufficiently to drive an audio transducer 400, such as headphones or one or more speakers. The output terminals 306 of audio amplifier 300 are connected to the input terminals 402 of audio transducer 400. Although, audio amplifier 300 is shown with a sing pair of output terminals, it should be understood that multiple separate outputs may be provided to simultaneously drive a plurality of audio transducers 400.

Turning now to FIGS. 2-6, there are shown schematic diagrams of tone blend configuration control 100 respectively at different settings to demonstrate the changes in pickup coil configuration that is obtained therewith. Tone blend configuration control 100 includes a pair of potentiometers 130 and 140 ($P_1$ and $P_2$) that provide the mechanism for changing the configuration of the pair of pickup coils 110 and 120 ($L_1$ and $L_2$) between being coupled in series at one end of the travel of potentiometers 130 and 140 and being coupled in parallel at the opposing end of the travel thereof. Potentiometers 130 and 140 each include a resistive element 132, 142 ($R_1$, $R_2$) connected between a pair of terminals 134, 136 and 144, 146 and a displace contact 138, 148 respectively coupled to an output terminal 139, 149. Potentiometers 130 and 140 are mechanically coupled together, as represented by the coupling line 108, and may be rotary or linear movement types with resistive elements $R_1$, $R_2$ being in the approximate range of 125 KΩ to 500 KΩ. In one working embodiment, potentiometers 130 and 140 were implemented as rotary type dual-gang potentiometers, which are two potentiometers combined on a common shaft, available from Bourns, Inc. of Riverside, Calif. and having the designation PDB182-GTRB with resistive elements 132 and 142 being 500 KΩ.

Potentiometer 130 has a resistance at 0% output with respect to terminal 136 over the initial 50% of mechanical travel of the displaceable contact 138 from the end connected to terminal 136 defined by the element portion 133, and increases linearly (linear taper) from 0% to 100% over the remaining 50% of the travel, defined by the element portion 132. While potentiometer 140 is constructed oppositely, with the resistance with respect to terminal 146 decreasing linearly (linear taper) from 100% to 0% over the initial 50% of mechanical travel of the displaceable contact 148 from the end connected to terminal 146 defined by the element portion 142, and remains at 0% over the remaining 50% of the travel, defined by the element portion 143. In some applications the musician who owns the string instrument incorporating tone blend configuration control 100 may prefer a nonlinear resistive taper, such as logarithmic taper which is also known as an audio taper, for either or both of potentiometers 130 and 140. Regardless of the taper, tone blend configuration control 100 will function as described herein with respect to the pickup coil configurations at the endpoints of mechanical travel of the displaceable contacts 138, 148 and at the midpoint of the mechanical travel.

Pickup coils 110 and 120 may be two separately mounted coils located on the instrument, each in proximity to the strings 10 at different locations along their extent or two collocated coils that are provided in a single package. Both types of pickup coils are well known and widely available. In one working embodiment, pickup coils 110 and 120 were implemented with a humbucking series EMG-HZ type pickup available from EMG, Inc. of Santa Rosa, Calif.

The following connections apply to each of FIGS. 2, 3, 4, 5, 6 and 7. Output terminal 104 is connected to terminal 114 of the first pickup coil 110 via a conductor 152, which is connected to a ground reference 106. All of the conductors of tone blend configuration control 100, 100' may formed by conductive wires, conductive tracks on a printed circuit board, or a combination thereof. Terminal 114 is further connected to terminal 134 of potentiometer 130 by the conductor 158. Output terminal 102 is coupled to a node 165 by the conductor 160, and the node 165 is coupled to terminal 122 of pickup coil 120 by the conductor 162. Node 165 is also coupled to the terminal 144 of potentiometer 140 by conductor 164. The opposing terminal 146 of potentiometer 140 is connected to terminal 136 of potentiometer 130 by the conductor 166. The displaceable contact terminal 139 potentiometer 130 is connected to the terminal 124 of pickup coil 120 by the conductor 156. Lastly, the displaceable contact terminal 149 potentiometer 140 is connected to the terminal 112 of pickup coil 110 by the conductor 154.

Figure 2:
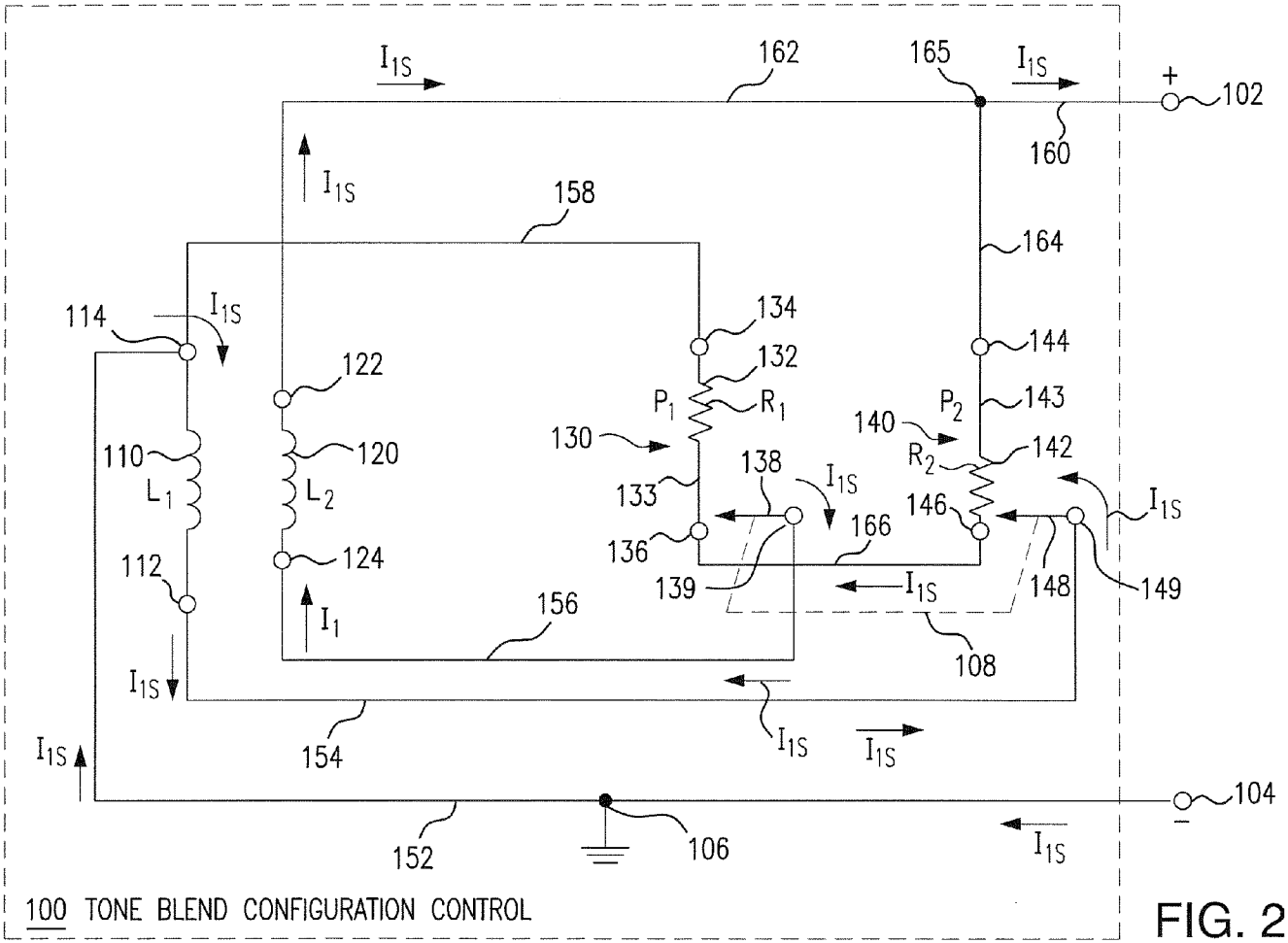
FIG. 2 is a schematic electrical diagram of the tone blend configuration control of the present invention adjusted for a series configuration.

The functioning of tone blend configuration control 100 will now be described, beginning with the displaceable contacts 138, 148 being at a first end of their respective mechanical travel, as shown in FIG. 2. At the first end of mechanical travel, the resistance between the terminals 136 and 139, as well as between terminals 146 and 149 of displaceable contacts 138, 148 is respectively zero ohms. Although the pickup coils 110 and 120 generate the current that flows to and from output terminals 102 and 104 responsive to vibrational movement of the strings 10 of the instrument incorporating tone blend configuration control 100, for simplicity we will start by following a current $I_{1S}$ flowing into the negative output terminal 104. The current $I_{1S}$ flows to terminal 114 of pickup coil 110 through the conductor 152 and from there flows through pickup coil 110 to terminal 112. While the conductor 158 connects terminal 114 to the terminal 134 of potentiometer 130, due to the high resistance, 100%, between terminal 134 and either of terminals 136 or 139 (due to the position of displaceable contact 138) the current that flows through that branch is negligible and thus, for practical purposes no current flows through that path.

From terminal 112, the current $I_{1S}$ flows through conductor 154 to terminal 149 of potentiometer 140, and from there through displaceable contact 148 to terminal 146. Again, for practical purposes, no current flows to terminal 144 of potentiometer of 140. The current $I_{1S}$ flows through conductor 166 to terminal 136 of potentiometer 130 and through displaceable contact 138 to terminal 139. From terminal 139 of potentiometer 130, the current $I_{1S}$ flows through conductor 156 to terminal 124 of pickup coil 120. The current $I_{1S}$ flows through pickup coil 120 to terminal 122 and through conductors 162 and 160 to positive output terminal 102; thereby completing the current path through tone blend configuration control 100. Clearly, as the same current, $I_{1S}$, flows through both pickup coils 110 and 120, the pickup coils are coupled in series. For series coupled pickup coils, the voltages generated in the coils is additive, but provide a higher impedance to higher frequency audio signals and hence they are said to provide a fuller and stronger sound.

Figure 3:
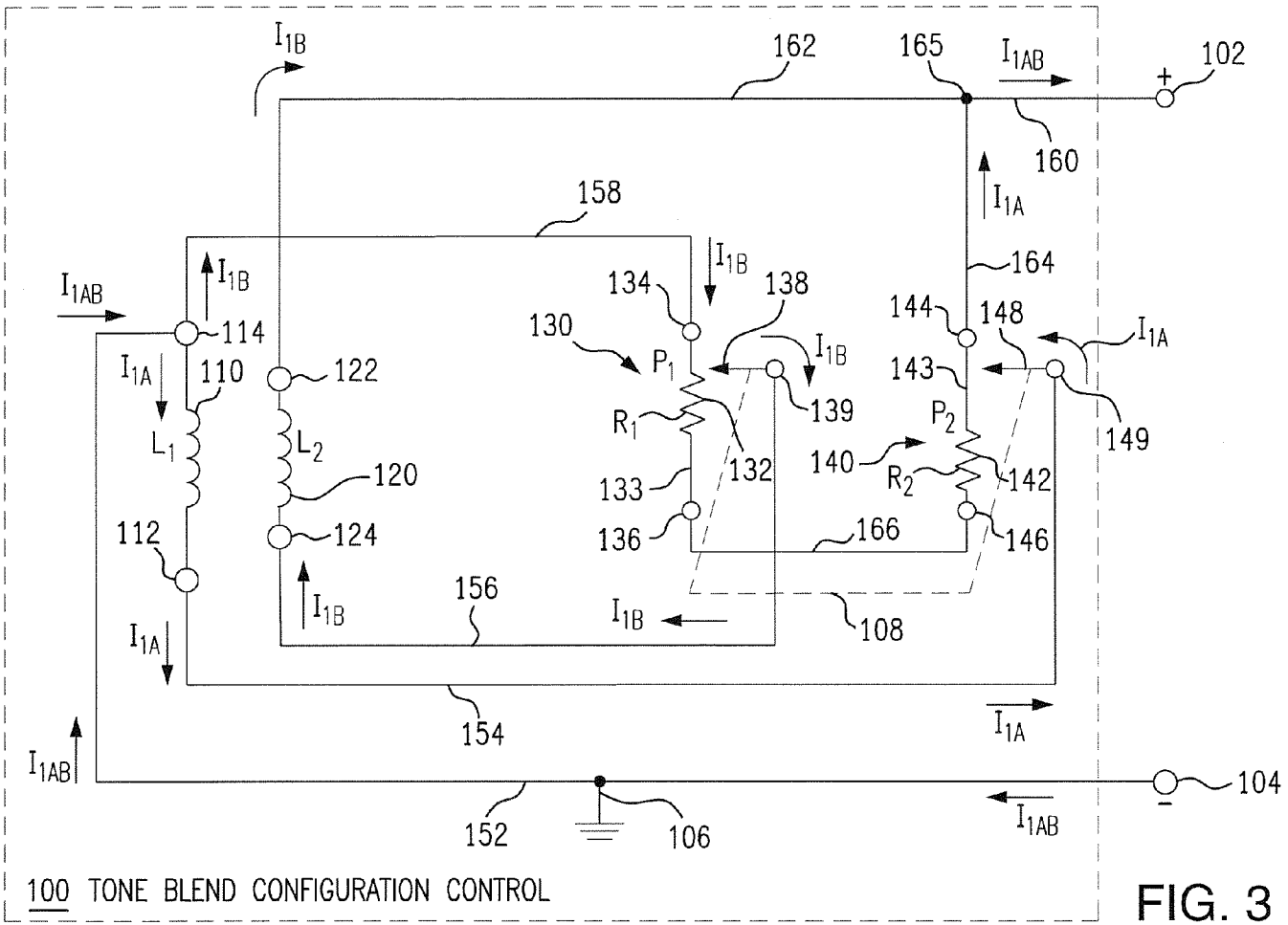
FIG. 3 is a schematic electrical diagram of the tone blend configuration control adjusted for a parallel configuration.

Turning now to FIG. 3, we will examine the resulting functioning of tone blend configuration control 100 when the displaceable contacts 138, 148 are positioned at the opposing second end of their respective mechanical travel. At the second end of the mechanical travel, the resistance between the terminals 136 and 139, as well as between terminals 146 and 149 of displaceable contacts 138, 148, is 100%. of the resistance of the corresponding resistive element 132, 142. By virtue of the displaceable contacts 138 and 148 being at the second end of the mechanical travel, the resistance between the terminals 134 and 139, as well as between terminals 144 and 149 of displaceable contacts 138, 148 is respectively zero ohms.

Starting again at negative output terminal 104, the current $I_{1AB}$ flows to terminal 114 of pickup coil 110 through the conductor 152. As the resistance between terminals 134 and 139 of potentiometer 130 is zero ohms, the current flowing to terminal 114 divides into a current $I_{1A}$ flowing through the pickup coil 110 and a current $I_{1B}$ flowing to terminal 134 of potentiometer 130 through the conductor 158. The current $I_{1A}$ flows from terminal 112 of pickup coil 110 to terminal 149 of potentiometer 140 through the conductor 154. From terminal 149 the current $I_{1A}$ flows through the displaceable contact 148 to terminal 144, and from there to node 165 through conductor 164. Due to the resistance of both resistive elements 142 and 132, no current flows from displaceable contact 148 to terminal 146, as it is negligible.

The current $I_{1B}$ flows from terminal 134, through displaceable contact 138 to terminal 139 of potentiometer 130. From terminal 139, the current $I_{1B}$ flows to terminal 124 of pickup coil 120 through the conductor 156. Current $I_{1B}$ flows through pickup coil 120 to terminal 122 thereof and through conductor 162 to node 165. At node 165 the currents $I_{1A}$ and $I_{1B}$ combine to define the current $I_{1AB}$ flowing through the conductor 160 to positive output terminal 102. Hence, the potentiometer setting in this example provides two parallel branches with a respective one of the two pickup coils in each branch. The parallel configuration results in a common voltage being generated by the pickup coils, a lower voltage than provided with the coils connected in series, but with a reduced high frequency impedance and thereby is said to produce a brighter sound.

Figure 4:
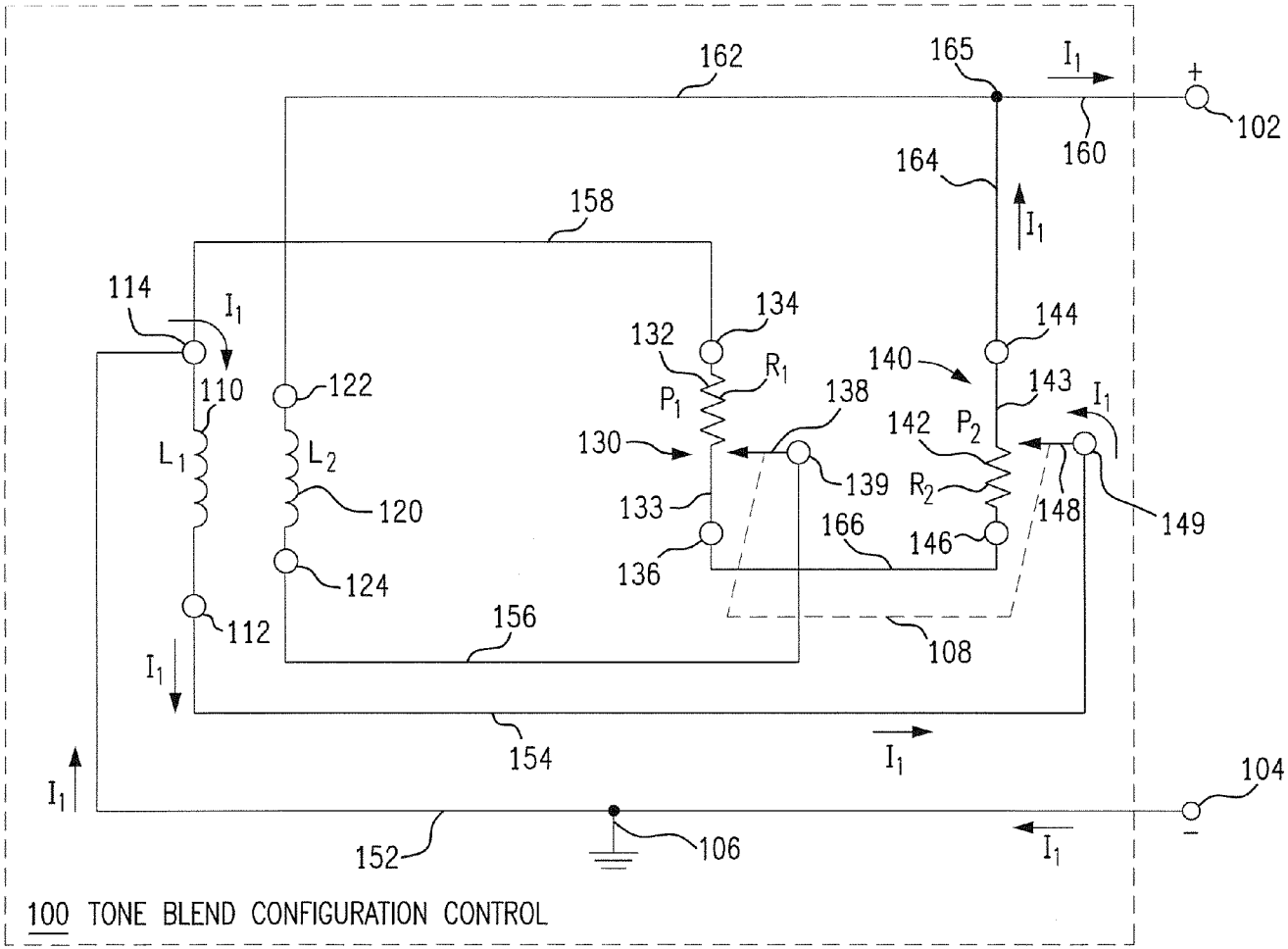
FIG. 4 is a schematic electrical diagram of the tone blend configuration control adjusted for a single coil configuration.

Tone blend configuration control 100 provides neither a series configuration of pickup coils 110 and 120 nor a parallel configuration thereof when the displaceable contact 138 and 148 of potentiometers 130 and 140 are set to the midpoint of their mechanical travel. As shown in FIG. 4, when the potentiometers 130, 140 are set at their midpoint of their mechanical travel, there is zero ohms resistance between terminals 139 and 136 of potentiometer 130 and 100% of the resistance between terminals 139 and 134. Looking at potentiometer 140, there is 100% of the resistance between terminals 149 and 146 thereof and zero ohms resistance between terminals 149 and 144.

A current $I_1$ flows from negative output terminal 104 to terminal 114 of pickup coil 110 through conductor 152. The current $I_1$ Flows through the pickup coil 110 to terminal 112 and through the conductor 154 to the displaceable contact terminal 149 of potentiometer 140. As in the exemplary condition discussed with respect to FIG. 2, no current (for practical purposes) flows through the conductor 158 due to the resistance between terminals 134 and 139 of potentiometer 130. From terminal 149, the current $I_1$ flows through the displaceable contact 148 to terminal 144 of potentiometer 140 through the conductive element portion 143. The current $I_1$ flows from terminal 144 to node 165 through the conductor 164 and through conductor 160 to the positive output terminal 102. It can therefore be seen that when the displaceable contacts are positioned at the midpoint of their mechanical travel, then no current flows through the pickup coil 120 and the output from tone blend configuration control 100 is only the result of voltages generated in pickup coil 110. To assist a musician find the midpoint of the mechanical travel of potentiometers 130 and 140, potentiometers 130 and 140 may incorporate a mechanical detent at the midpoint of the mechanical travel of the corresponding displaceable contacts 138, 148 to provide a tactile indication thereof.

Figure 5:
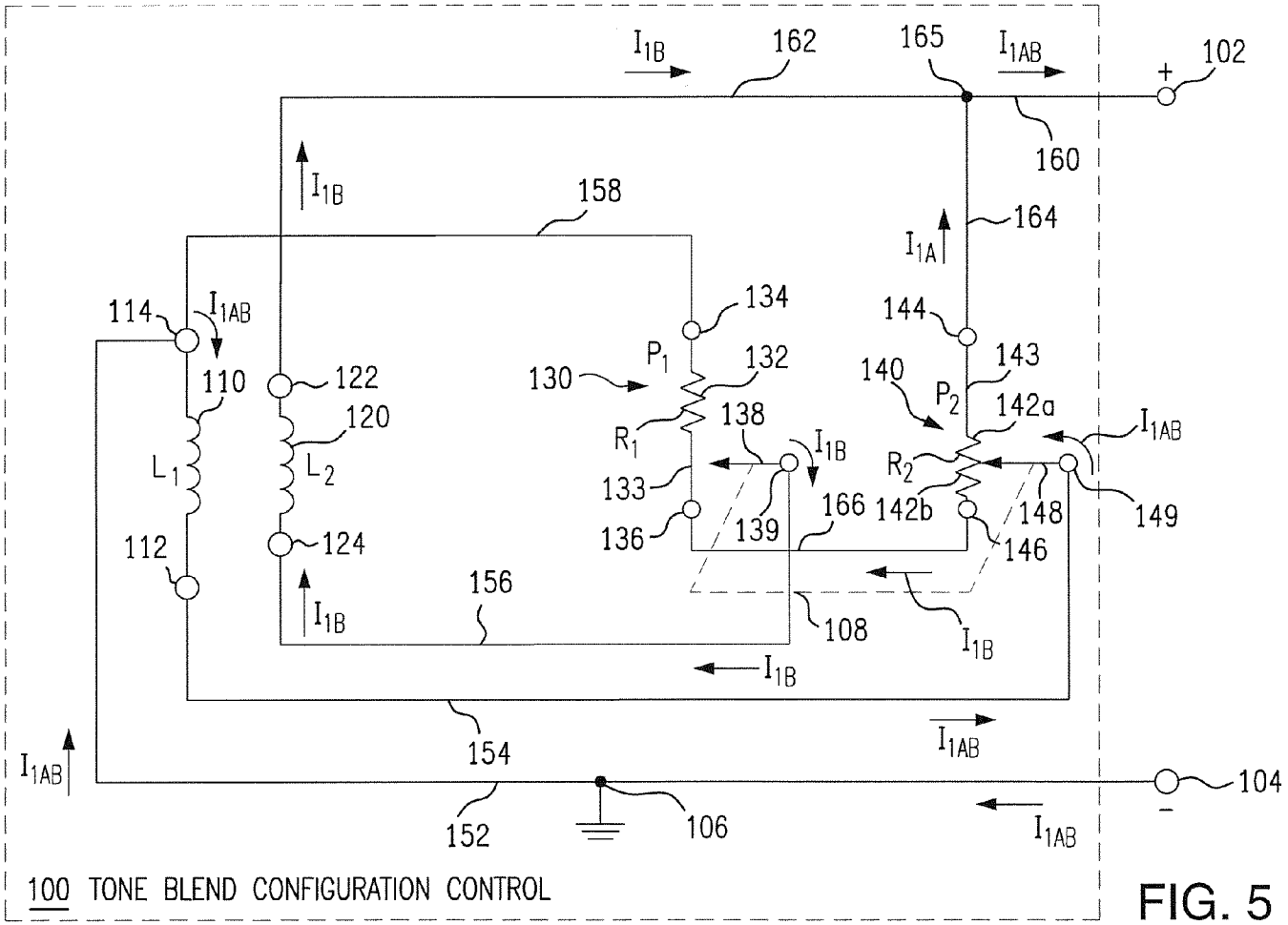
FIG. 5. is a schematic electrical diagram of the tone blend configuration control adjusted for a first varied configuration.

It can be seen from the examples illustrated in FIGS. 2-4 that tone blend configuration control 100 configures the electrical connection of the two pickup coils 110 and 120 in either series or parallel at opposing ends of the mechanical travel of potentiometers 130 and 140. Further, when the displaceable contacts 138 and 148 of potentiometers 130 and 140 are set at the midpoint of their mechanical travel, then pickup coil 120 is electrically disconnected and only pickup coil 110 provides generated voltage signals across the output terminals 102 and 104. FIGS. 5 and 6 provide examples where the displaceable contacts 138 and 148 of potentiometers 130 and 140 are set at a position intermediate one end and the midpoint of the mechanical travel of the potentiometers 130 and 140.

Referring to FIG. 5, the displaceable contacts 138 and 148 of potentiometers 130 and 140 are shown set at a position that is intermediate the positions that were shown in FIGS. 2 and 4, intermediate the first ends of the mechanical travel and the midpoint thereof. As a result of 100% of the resistance of potentiometer 130 being between terminals 134 and 139, no current flows through the conductor 158, as in the example of FIG. 2. However, unlike that example, some current will flow through the conductor 164, since less than 100% of the resistance will be between the terminals 149 and 144.

A current $I_{1AB}$ flows from the negative output terminal 104 through conductor 152 to terminal 114 of pickup coil 110 and through that pickup coil to terminal 112, conductor 154 to the displaceable contact terminal 149 of potentiometer 140. The current $I_{1AB}$ flows through the displaceable contact 148 and divides between resistive element portions 142*a* and 142*b*. The current $I_{1AB}$ divides in inverse proportion to the resistance values (directly proportional to the conductance) of the resistive element portions 142*a* and 142*b*. Thus, a current $I_{1A}$ flows from terminal 144 of potentiometer 140, having flowed thereto through the resistive element portion 142*a* and element portion 143, to node 165 through conductor 164. A current $I_{1B}$ flows through resistive element portion 142*b* to flow from terminal 146 of potentiometer 140 to terminal 136 of potentiometer 130 through conductor 166. Current $I_{1B}$ flows through the element portion 133 and displaceable contact 138 to terminal 139. From terminal 139 of potentiometer 130, the current $I_{1B}$ flows to terminal 124 of pickup coil 120 through conductor 156, through that pickup coil to terminal 122, and then to node 165 through conductor 162. At node 165 the currents $I_{1A}$ and $I_{1B}$ combine to define the current $I_{1AB}$ which flows from node 165 through conductor 160 to positive output terminal 102. Thus, the total current exiting terminal 102 and returning to terminal 104, identified as the current $I_{1AB}$, flows through pickup coil 110. Whereas, only a portion of the current that passes through pickup coil 110 ($I_{1AB}$) flows through pickup coil 120, thereby providing a blending of the series and parallel effects.

Figure 5A:
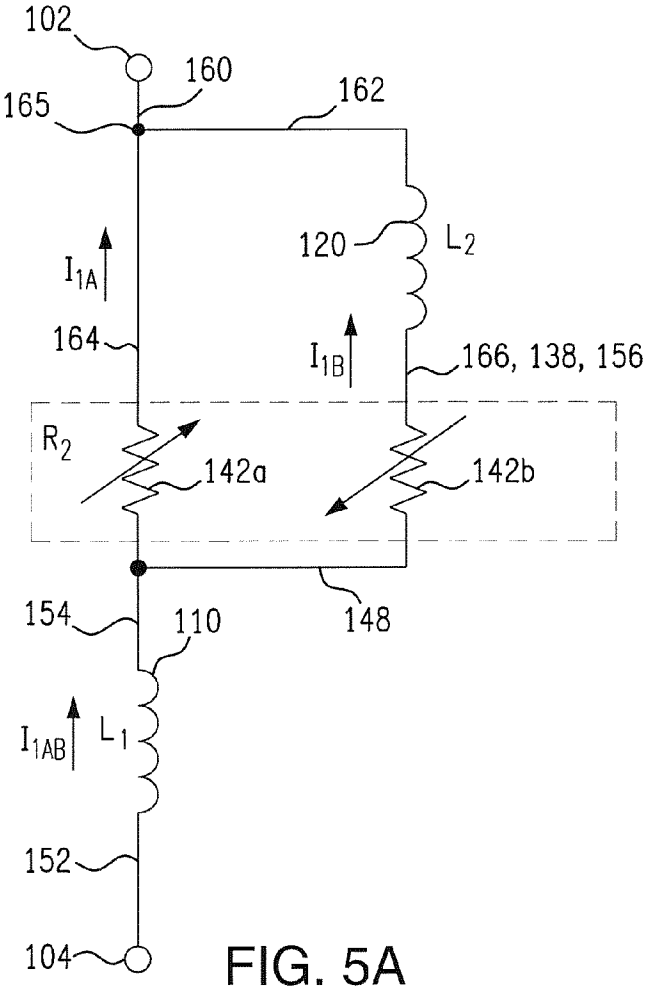
FIG. 5A is an equivalent circuit for the first varied configuration shown in FIG. 5.

To better see the series and parallel current flows, refer now to FIG. 5A which shows the equivalent circuit for this example. As illustrated, as the resistance of resistive element portion 142*a* increases, the resistance of resistive element portion 142*b* decreases and conversely as resistive element portion 142*b* increases, the resistance of resistive element portion 142*a* decreases. Thus as the resistance of resistive element portion 142*a* increases from a point where the resistance of the resistive element portions are equal, the resulting tone output approaches that obtained when the pickup coils 110 and 120 are 100% connected in series. However, as the resistance of resistive element portion 142*a* decreases from a point where the resistance of the resistive element portions are equal, the resulting tone output approaches that obtained from a single pickup coil, pickup coil 110.

Referring now to FIG. 6, the displaceable contacts 138 and 148 of potentiometers 130 and 140 are shown set at a position that is intermediate the positions that were shown in FIGS. 3 and 4, intermediate the second ends of the mechanical travel and the midpoint thereof. As a result of 100% of the resistance of potentiometer 140 being between terminals 149 and 146, no current flows through the resistive element portion 132*b*, element portion 133 and the conductor 166, as in the example of FIG. 3. As in the example of FIG. 5, a current $I_{1AB}$ flows from the negative output terminal 104 through conductor 152 to terminal 114 of pickup coil 110 and divides into a current $I_{1A}$ that flows through conductor 158 to terminal 134 of potentiometer 130, and a current $I_{1B}$ that flows through pickup coil 110 to terminal 112. The current $I_{1B}$ flows from terminal 112 to terminal 149 of potentiometer 140 via the conductor 154. From terminal 149, the current $I_{1B}$ flows to terminal 144 of potentiometer 140 through the displaceable contact 148 and element portion 143, and flows through conductor 164 to node 165.

The current $I_{1A}$ flows through the resistive element portion 132*a* and displaceable contact 138 to terminal 139. From terminal 139, current $I_{1A}$ flows through the conductor 156 to terminal 124 of pickup coil 120. Not unlike the example illustrated in FIG. 3, no current flows through the conductor 166 due to the resistance between terminals 146 and 149 of potentiometer 140 being 100% of the resistance of the resistive element 142. The current $I_{1A}$ flows from terminal 124 through pickup coil 120 to terminal 122 thereof, and through the conductor 162 to node 165. At node 165 the currents $I_{1A}$ and $I_{1B}$ combine to define the current $I_{1AB}$ which flows from node 165 through conductor 160 to positive output terminal 102. Thus, portions ($I_{1A}$ and $I_{1B}$) of the current exiting terminal 102 and returning to terminal 104, the current $L_{AB}$, respectively flows through pickup coil 120 and 110, thereby providing parallel effects with varying resistance in series with the pickup coil 120.

Figure 6A:
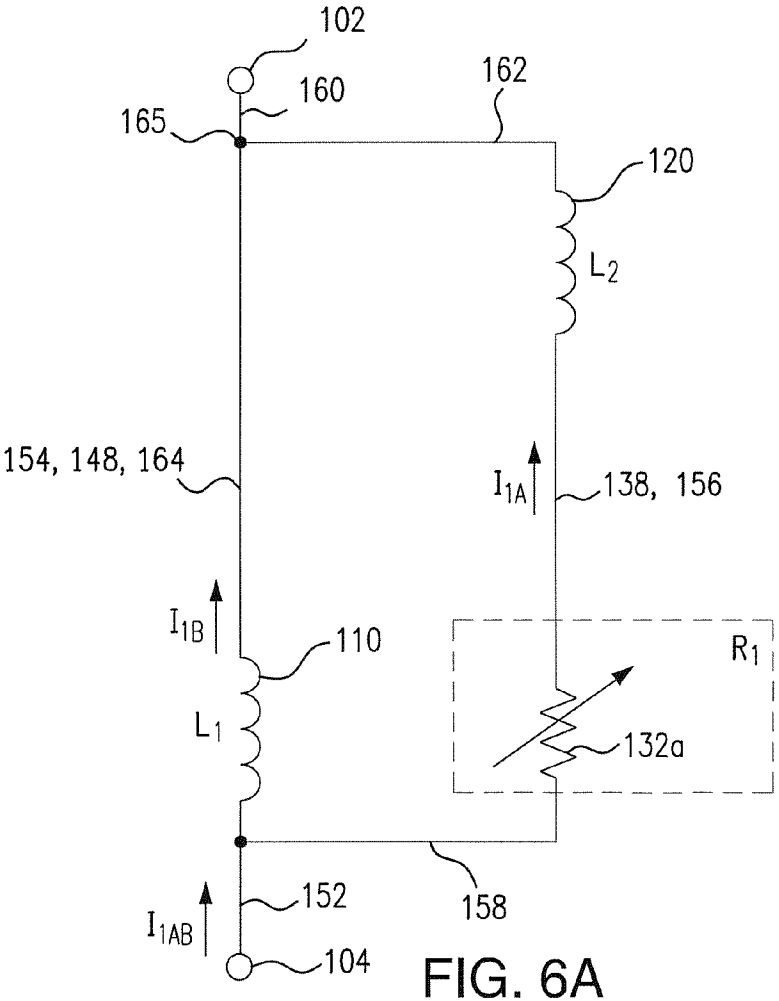
FIG. 6A is an equivalent circuit for the second varied configuration shown in FIG. 6.
Figure 6:
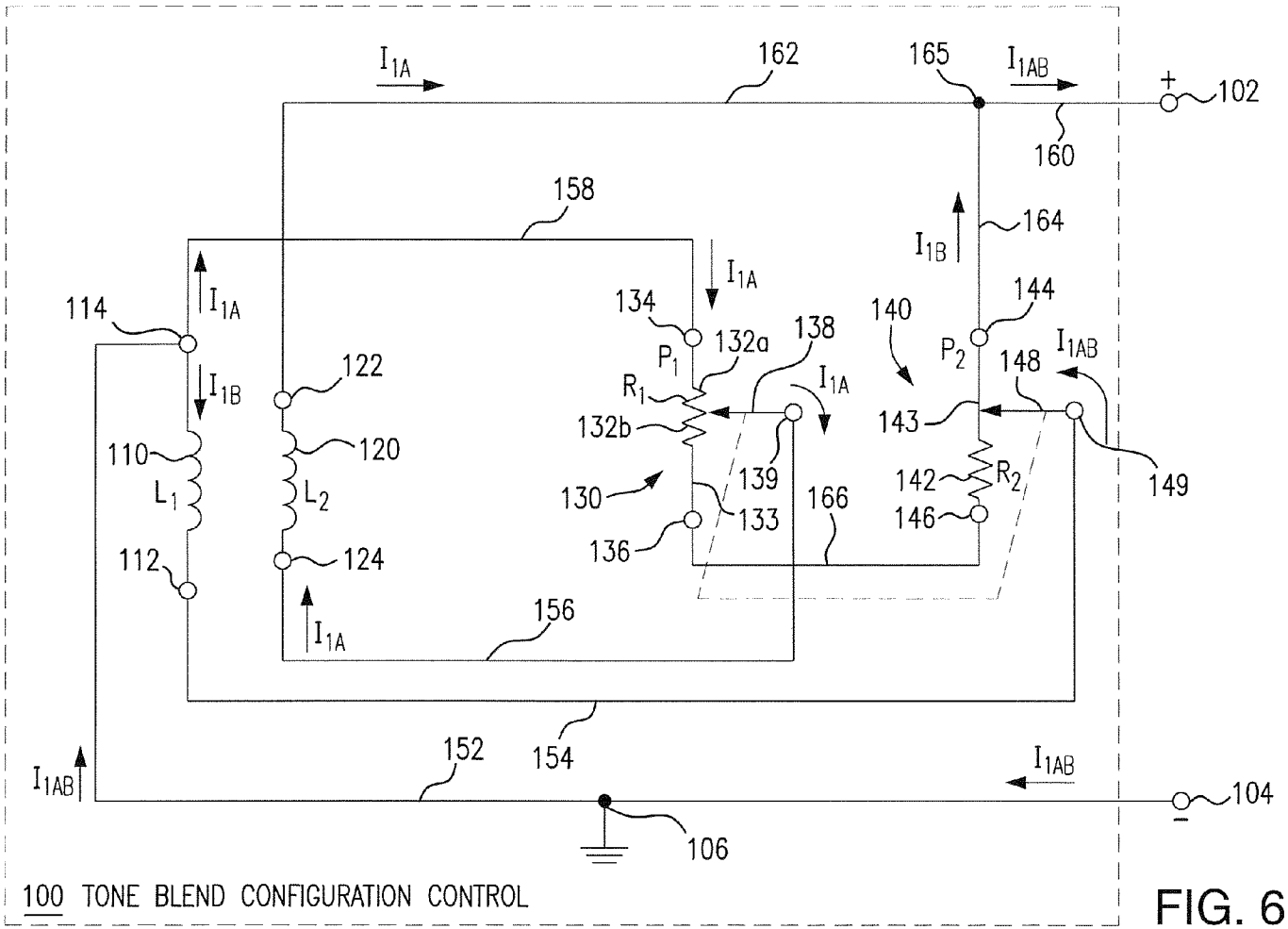
FIG. 6. is a schematic electrical diagram of the tone blend configuration control adjusted for a second varied configuration.

FIG. 6A is the equivalent circuit for the example of FIG. 6 and illustrates the range of effects that are achieved when the displaceable contacts 138, 148 are positioned at a position that is intermediate the second ends of the mechanical travel and the midpoint thereof. When the resistance of resistive element portion 132*a* is increased to approach 100% of the resistance of the entire resistive element, the current value of current $I_{1A}$ is diminished and the effect approaches that of a single pickup coil, the pickup coil 110. When the resistance of resistive element portion 132*a* is decreased to approach 0% of the resistance of the entire resistive element, the current value of current $I_{1A}$ increases and the effect approaches that of the parallel pickup coils illustrated in FIG. 3.

Figure 7:
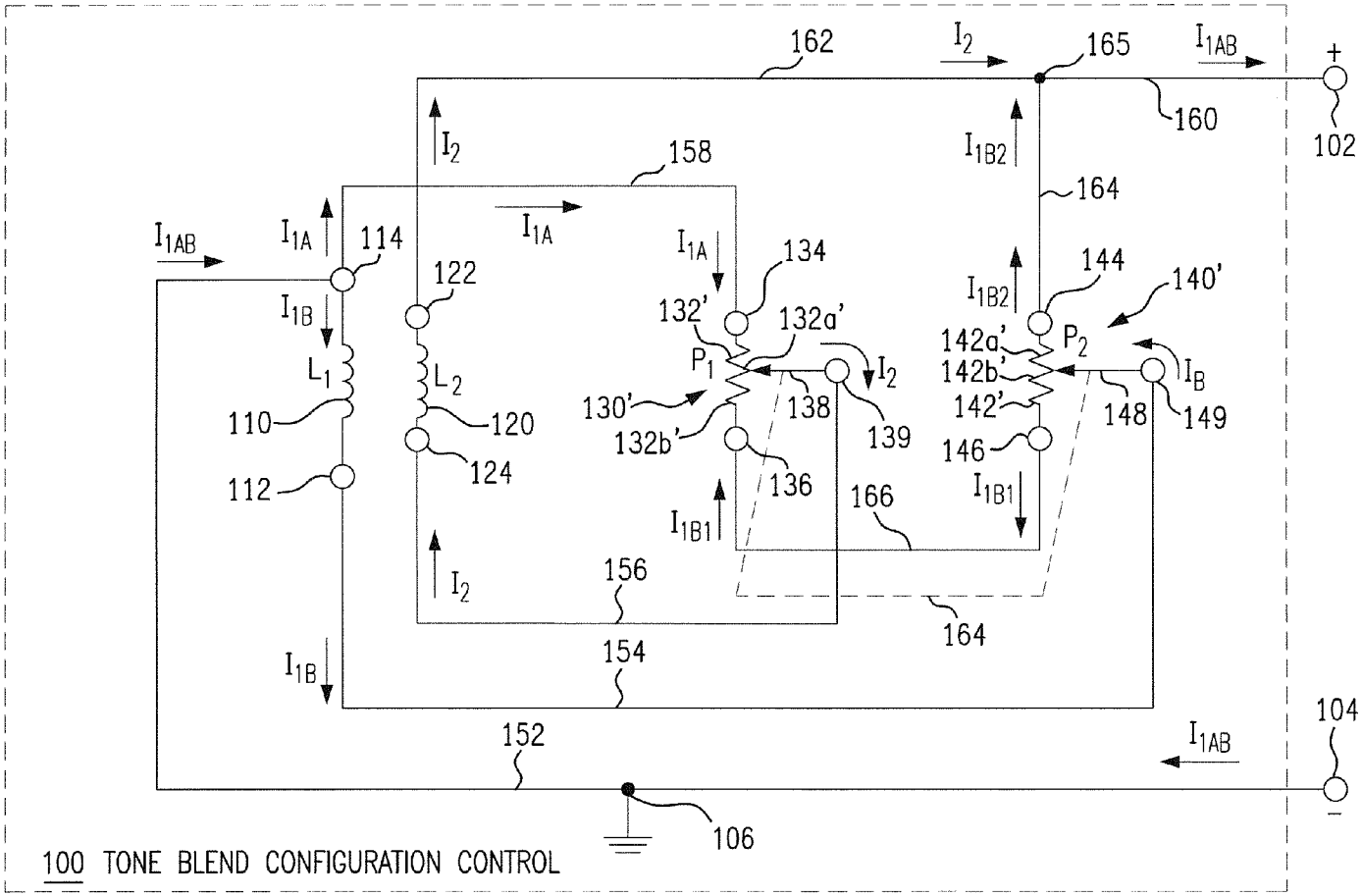
FIG. 7 is a schematic electrical diagram of another arrangement of the tone blend configuration control of the present invention.

Turning now to FIG. 7, there is illustrated tone blend configuration control 100'. Tone blend configuration control 100' differs from tone blend configuration control 100, described in preceding paragraphs, by the internal construction of the potentiometers 130' and 140'. The potentiometers 130' and 140' of tone blend configuration control 100' have respective resistive elements 132' and 142' with a taper that extend between the first and second ends of the mechanical travel of the corresponding displaceable contacts 138 and 148 thereof. In working embodiments, potentiometers 130' and 140' were implemented as rotary type dual-gang potentiometers available from Bourns, Inc. of Riverside, Calif. and having the designation PDB182-K420K-504B (linear taper) or PDB182-K420K-504A (logarithmic taper) with resistive elements 132' and 142' being 500 KΩ. Tone blend configuration control 100' operates identically to tone blend configuration control 100 at the two extremes of the mechanical travel of potentiometers 130' and 140', configuring the pickup coils 110 and 120 in series when set at the first end of the mechanical travel and configuring pickup coils 110 and 120 in parallel when set at the second end of the mechanical travel. However, when using resistive elements 132' and 142' with a linear taper, tone blend configuration control 100' will function differently than that of tone blend configuration control 100 at the midpoint of the mechanical travel of potentiometers 130' and 140'.

Thus, we begin to look at tone blend configuration control 100' by considering the circuit with the displaceable contacts 138 and 148 set at the midpoint of their mechanical travel. The current $I_{1AB}$ flows from the negative output terminal 104 to terminal 114 of pickup coil 110, where the current divides with one portion $I_{1A}$ flowing therefrom through conductor 158 to terminal 134 of potentiometer 130'. The other portion $I_{1B}$ of current $I_{1AB}$ flows through pickup coil 110 to terminal 112 and on to the displaceable contact terminal 149 of potentiometer 140' through conductor 154. The current $I_{1B}$ flows through the displaceable contact 148 and divides in the resistive element 142' to establish a current $I_{1B2}$ flowing through the resistive element portion 142*a'* and a current $I_{1B1}$ flowing through the resistive element portion 142*b'*. The current divides in proportion to the conductance of the resistive element portions 142*a'*, 142*b'*, which in this particular example are equal when the displaceable contact 148 is at the midpoint of its mechanical travel. The current $I_{1B2}$ flows through resistive element portion 142*a'* to terminal 144 and continues through the conductor 164 to node 165. The current $I_{1B1}$ flows through resistive element portion 142*b'* to terminal 146 and therefrom to terminal 136 of potentiometer 130' via conductor 166. The current $I_{1B1}$ flows from terminal 136 to the displaceable contact 138, and the current $I_{1A}$ flows from terminal 134 through resistive element portion 132*a'* to displaceable contact 138 to combine with the current $I_{1B1}$. The resultant current of the combination of $I_{1A}$ and $I_{1B1}$ is designated $I_2$ and flows to the displaceable contact terminal 139 of potentiometer 130'. From terminal 139, the current $I_2$ flows through the conductor 156 to terminal 124 of pickup coil 120. The current $I_2$ flows through pickup coil 120 to terminal 122 and through conductor 162 to the node 165, where the current $I_2$ combines with the current $I_{1B2}$ to define the current $I_{1AB}$ flowing from node 165 to the positive output terminal 102. Thus, at the midpoint of the mechanical travel there is a component of the total current that flow through the series arrangement of the pickup coils and components that flow through the pickup coils in parallel.

Figure 7A:
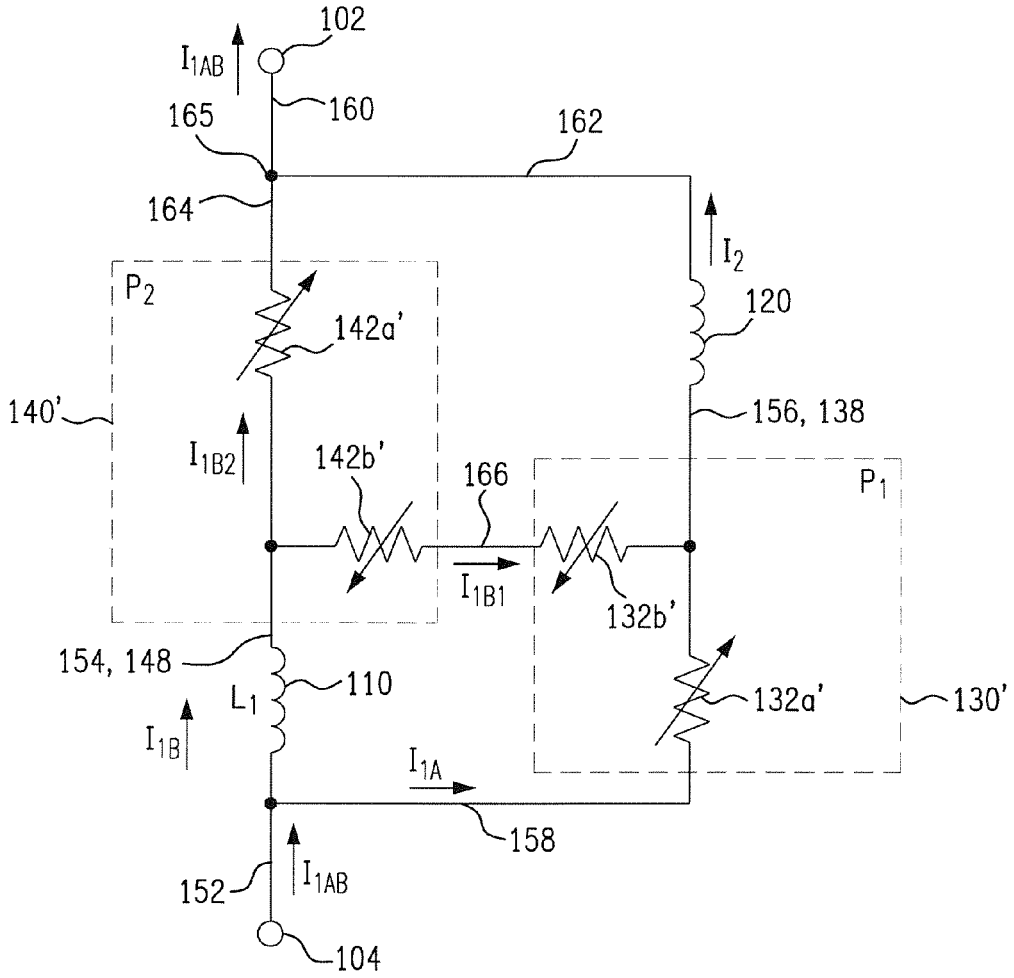
FIG. 7A. is an equivalent circuit for the tone blend configuration control shown in FIG. 7.

Referring now to FIG. 7A, there is shown an equivalent circuit for the example of FIG. 7. The equivalent circuit illustrates the range of effects that are achieved by displacement of the displaceable contacts 138 and 148. At the first and second ends of the mechanical travel one or the other of the resistive element portions 132*a'*, 142*a'* or 132*b'*, 142*b'* will be 0% of the total resistance of the resistive element 132', 142' while the complementary resistive element portions 132*b'*, 142*b'* or 132*a'*, 142*a'* will be 100% of the total resistance of the resistive element 132', 142'. Thus, it can be seen that when the resistive element portions 132*a'*, 142*a'* are essentially zero ohms no current flows through the conductor 166 because of the high resistance of the resistive element portions 132*b'*, 142*b'*. Under these conditions, the pickup coils 110 and 120 are thereby configured in a parallel circuit arrangement. Likewise, when the resistive element portions 132*b'*, 142*b'* are essentially zero ohms no current flows through the conductors 158, 164 because of the high resistance of the resistive element portions 132*a'*, 142*a'* to thereby configure pickup coils 110 and 120 in series.

As a consequence of the resistive element portions 132*b'*, 142*b'* being in series and the resistive elements 132', 142' having a linear taper, substantially no current will flow through the conductor 166 until the displaceable contacts 138, 148 are displaced from the second end of the mechanical travel to a position beyond the midpoint thereof. Accordingly, the pickup coils 110 and 120 remain in a parallel configuration, with a varying amount of series resistance when the displaceable contacts 138, 148 are positioned between the second end and midpoint of the mechanical travel thereof. Beyond the midpoint, a series current component is introduced and which increases, as the parallel current components decrease, as the displaceable contacts 138, 148 are positioned between the midpoint and the first end of the mechanical travel.

The position of the displaceable contacts 138, 148 with respect to the midpoint of the mechanical travel where the series current component is introduced can be altered to be more toward the second end by lowering the resistance value of resistive elements 132', 142'. Another method by which the location where the series current component begins to be introduced can be shifted is by the use of potentiometers having resistive elements with logarithmic tapers arranged to increase in resistance from opposite ends to the mechanical travel. In fact, single pickup coil operation at or near the midpoint of the mechanical travel of displaceable contacts 138', 148', like that discussed with respect to FIG. 4, can be achieved, albeit with some resistance of resistive element portion 142*a'* in series with pickup coil 110 for tone blend configuration control 100'. To provide the single coil configuration at or near the midpoint of the mechanical travel, the resistive elements 132' and 142' of potentiometers 130', 140' are provided with logarithmic tapers arranged as discussed above, but with a higher total resistance than that discussed with respect to the potentiometers of tone blend configuration control 100, such as a range of 200 KΩ to 750 KΩ.

The descriptions above are intended to illustrate possible implementations of the present invention and are not restrictive. While this invention has been described in connection with specific forms and embodiments thereof, it will be appreciated that various modifications other than those discussed above may be resorted to without departing from the spirit or scope of the invention. Such variations, modifications, and alternatives will become apparent to the skilled artisan upon review of the disclosure. For example, functionally equivalent elements may be substituted for those specifically shown and described, and certain features may be used independently of other features, and in certain cases, particular locations of elements may be reversed or interposed, all without departing from the spirit or scope of the invention as defined in the appended Claims. The scope of the invention should therefore be determined with reference to the description above, the appended claims and drawings, along with their full range of equivalents.

What is being claimed is:

1. A variable tone configuration control for string instruments, comprising:

a pair of pickup coils disposed on a string instrument for inducing voltages therein responsive to vibration of at least one string of the string instrument; and a pair of potentiometers each having a displaceable contact, said pair of potentiometers being mechanically coupled for concurrent mechanical travel of said displaceable contacts thereof, said pair of potentiometers being coupled to a pair of output terminals, and said pair of displaceable contacts being coupled to said pair of pickup coils, said pair of potentiometers providing selective operative coupling of said pair of pickup coils to said output terminals responsive to a position of said displaceable contacts, wherein said selective operative coupling includes (a) said pair of pickup coils being coupled in series to said output terminals, or (b) said pair of pickup coils being coupled in parallel to said output terminals, or (c) effectively coupling only one of said pair of pickup coils to said output terminals, said effectively coupling of only one of said pair of pickup coils to said output terminals being responsive to said displaceable contacts being positioned at an intermediate position of said mechanical travel thereof.

2. The variable tone configuration control for string instruments as recited in claim 1, where each of said pair of potentiometers has a detent at said intermediate position of said mechanical travel of said displaceable contacts where said one of said pair of pickup coils is operatively coupled to said output terminals to provide a tactile indication thereof.

3. The variable tone configuration control for string instruments as recited in claim 2, where said detent is located at a midpoint of said mechanical travel of said displaceable contacts.

4. The variable tone configuration control for string instruments as recited in claim 2, where each of said pair of potentiometers has a substantial resistance between said position of said detent and one end position of said displaceable contact mechanical travel and an insignificant resistance between said position of said detent and an opposing end position of said displaceable contact mechanical travel.

5. The variable tone configuration control for string instruments as recited in claim 4, where said substantial resistance of a first of said pair of potentiometers is disposed between said position of said detent and a first end position of said displaceable contact mechanical travel thereof, and said substantial resistance of a second of said pair of potentiometers is disposed between said position of said detent and a second end position of said displaceable contact mechanical travel thereof.

6. The variable tone configuration control for string instruments as recited in claim 5, where a terminal of said first of said pair of potentiometers connected to said first end position of said displaceable contact mechanical travel thereof is coupled to another terminal of a first of said pair of pickup coils.

7. The variable tone configuration control for string instruments as recited in claim 5, where a terminal of said second of said pair of potentiometers connected to said first end position of said displaceable contact mechanical travel thereof is coupled to one of said pair of output terminals.

8. The variable tone configuration control for string instruments as recited in claim 5, where a terminal of each of said pair of potentiometers respectively connected to said second end position of said displaceable contact mechanical travel thereof are connected to one another.

9. The variable tone configuration control for string instruments as recited in claim 1, where each of said pair of potentiometers has a substantial resistance between a midpoint in said mechanical travel of said displaceable contact and one end position of said mechanical travel of said displaceable contact and an insignificant resistance between said midpoint in said mechanical travel of said displaceable contact and an opposing end position of said mechanical travel of said displaceable contact.

10. The variable tone configuration control for string instruments as recited in claim 9, where said substantial resistance of a first of said pair of potentiometers is disposed between said midpoint in said mechanical travel and a first end position of said mechanical travel, and said substantial resistance of a second of said pair of potentiometers is disposed between said midpoint in said mechanical travel and a second end position of said mechanical travel.

11. The variable tone configuration control for string instruments as recited in claim 10, where a terminal of said first of said pair of potentiometers connected to said first end position of said displaceable contact mechanical travel thereof is coupled to another terminal of a first of said pair of pickup coils.

12. The variable tone configuration control for string instruments as recited in claim 10, where a terminal of said second of said pair of potentiometers connected to said first end position of said displaceable contact mechanical travel thereof is coupled to one of said pair of output terminals.

13. The variable tone configuration control for string instruments as recited in claim 10, where a terminal of each of said pair of potentiometers respectively connected to a second end position of said displaceable contact mechanical travel are connected to one another.

14. The variable tone configuration control for string instruments as recited in claim 1, where said pair of pickup coils are collocated on a string instrument in proximity to strings thereof.

15. The variable tone configuration control for string instruments as recited in claim 1, where each of said pair of pickup coils is separately located on a string instrument each in respective proximity to strings thereof.

16. The variable tone configuration control for string instruments as recited in claim 1, where a terminal of each of said pair of potentiometers respectively connected to a common end position of said displaceable contact mechanical travel are connected to one another.

17. The variable tone configuration control for string instruments as recited in claim 1, where said intermediate position of said mechanical travel is a midpoint in said mechanical travel of said displaceable contacts.

18. A variable tone configuration control for string instruments, comprising:

a pair of pickup coils disposed on a string instrument for inducing voltages therein responsive to vibration of at least on string of the string instrument; and a pair of potentiometers each having a displaceable contact, said pair of potentiometers being mechanically coupled for concurrent mechanical travel of said displaceable contacts thereof, each of said displaceable contacts being coupled to a respective one of said pair of pickup coils, each of said pair of potentiometers having a respective pair of terminals coupled to opposing ends of a resistive element thereof at corresponding end positions of said mechanical travel, one of said pair of terminals of each of said pickup coils being coupled to a respective one of a pair of output terminals, said pair of potentiometers controlling a current path selectively through one or both of said pair of pickup coils to thereby provide selective operative coupling of said pair of pickup coils coupled in series with respect to said output terminals responsive to said displaceable contacts being positioned at one end of said mechanical travel, or said pair of pickup coils coupled in parallel with respect to said output terminals responsive to said displaceable contacts being positioned at an opposing end of said mechanical travel, or a single one of said pair of pickup coils coupled to said output terminals responsive to said displaceable contacts being positioned at another position other than one of said ends of mechanical travel.

19. The variable tone configuration control for string instruments as recited in claim 18, where said other than one of said ends of mechanical travel being positioned centrally with respect to said mechanical travel of said displaceable contacts.

20. A variable tone configuration control for string instruments, comprising:

a pair of pickup coils disposed on a string instrument for inducing voltages therein responsive to vibration of at least on string of the string instrument; and a first potentiometer having a first displaceable contact and a second potentiometer having a second displaceable contact, said first and second displaceable contacts being mechanically coupled for concurrent mechanical travel thereof, said first and second potentiometers being coupled to a pair of output terminals and said pair of pickup coils, said first potentiometer having a first substantial resistance disposed between a first end position of said mechanical travel of said first displaceable contact and a position intermediate said first end position and an opposing second end position of said mechanical travel, said first potentiometer having a first insignificant resistance disposed between said intermediate position and said second end position of said mechanical travel of said first displaceable contact, and said mechanical travel of said second displaceable contact having a first end position, an intermediate position and second end position disposed in respective correspondence with said first end position, said intermediate position and said second end position of said first displaceable contact's mechanical travel, said second potentiometer having a second substantial resistance disposed between said intermediate position of said second displaceable contact's mechanical travel and said second end position thereof and a second insignificant resistance disposed between said intermediate position of said second displaceable contact's mechanical travel and said first end position thereof, said first and second potentiometers controlling a current path selectively through one or both of said pair of pickup coils, said current path being selective between (a) said pair of pickup coils being coupled in series with respect to said output terminals, (b) said pair of pickup coils being coupled in parallel with respect to said output terminals, and (c) a single one of said pair of pickup coils being coupled to said output terminals, said selection of said single one of said pair of pickup coils being responsive to said first and second displaceable contacts being respectively disposed at said intermediate positions of said corresponding mechanical travel thereof.

21. The variable tone configuration control for string instruments as recited in claim 20, where said mechanical travel of each of said first and second displaceable contacts has a detent at said intermediate position thereof to provide a tactile indication of said position selecting said single one of said pair of pickup coils being coupled to said output terminals.

* * * * *